US006105623A

United States Patent [19]

Tönz et al.

[11] Patent Number: 6,105,623

[45] Date of Patent: Aug. 22, 2000

[54] WEAVING HEDDLES HAVING DISTANCING DEFORMATIONS

[75] Inventors: Erwin Tönz, Samstagern; Franz Mettler, Wollerau, both of Switzerland

[73] Assignee: Grob Horgen AG, Horgen, Switzerland

[21] Appl. No.: 09/226,122

[22] Filed: Jan. 7, 1999

[30] Foreign Application Priority Data

Jan. 12, 1998 [DE] Germany ..... 198 00 811

[51] Int. Cl.[7] ..... D03C 9/02; D03C 9/04

[52] U.S. Cl. ..... 139/93

[58] Field of Search ..... 139/93

[56] References Cited

U.S. PATENT DOCUMENTS

| | | | |
|---|---|---|---|
| 1,246,002 | 11/1917 | Hathaway . | |
| 1,517,129 | 11/1924 | Ruegg, Jr. | 139/93 |
| 1,545,904 | 7/1925 | Kaufmann . | |
| 1,697,645 | 1/1929 | Goodspeed | 139/93 |
| 1,970,175 | 8/1934 | Kaufmann | 139/93 |
| 2,252,184 | 8/1941 | Kaufmann . | |
| 2,426,456 | 8/1947 | Kaufmann . | |
| 3,349,811 | 10/1967 | Kaufmann . | |

FOREIGN PATENT DOCUMENTS

| | | |
|---|---|---|
| 407 911 | 9/1966 | Switzerland . |

*Primary Examiner*—Andy Falik

*Attorney, Agent, or Firm*—Watson Cole Grindle Watson, P.L.L.C.

[57] ABSTRACT

Weaving heddles adapted to be arranged in pairs on a heddle frame of a weaving machine have at least three deformations or corrugations provided to space the individual heddles of the pair apart and to space the pair of heddles apart from adjacent heddles in adjacent pairs. A first of the deformations is located at one of the end loops at the upper end of the pair, a second of the deformations is located at one of the end loops at the lower end of the pair, and a third of the deformations is spaced a predetermined distance in a direction toward the thread eye of the heddle away from the end loop at the lower end of the pair.

8 Claims, 3 Drawing Sheets

WEAVING HEDDLES HAVING DISTANCING DEFORMATIONS

BACKGROUND OF THE INVENTION

This invention relates generally to weaving heddles adapted to be arranged upright in pairs on a heddle frame of a weaving machine of the type utilizing weft injection via a water jet.

The system of weft injection renders the weaving heddles constantly wet such that adjacent heddles tend to stick together, especially at the ends arranged in a row in the heddle frame on the bottom heddle support bar. Because the weaving heddles are so light (each heddle weighing between 1 and 2.5 g) in many cases, the cohesive force of the water is sufficient that they easily stick to one another. This sticking effect is enhanced in most cases in that the water is mixed with the sizing material which comes off the warp threads thereby greatly strengthening the sticking effect.

This sticking together of the weaving heddles is not a new problem and certain methods to remedy the problem have been developed. Nevertheless, the problem has been substantially complicated by the introduction of ever sensitive warp yarns. Among such yarns are the so-called micro fiber yarns which have the need to be processed at very low warp tensions. Thus, even a slight sticking together of the weaving heddles causes warp stripes in the fabric which reduces the quality and sellability of such fabric. Known methods which, among others, are closely related to the known solutions for the problems associated with the pulling-in of the warp threads, are clearly inadequate.

The invention is especially adaptable to heddles with a double row of thread eyes located in a plurality of different horizontal planes, as set forth in U.S. Pat. No. 1,545,904. Such heddles is utilized are presently in a similarly or slightly modified form for fabric made of fine yarns. Such a heddle pair designed to accommodate the number of revolutions of today's weaving machines, is shown generally in FIG. 1 of the present drawings. It can therefore be appreciated that, especially in the area of the end loops at the opposing the heddles, the heddles have relatively large surfaces such that when wetted with water and residues of sizing material cause the heddles to stick together.

Swiss patent 407911 discloses the provision of embossments for maintaining adjacent heddles spaced apart. However the embossments define contact points which are rather small and therefore insufficient to effectively prevent the sticking together of the adjacent heddles.

Other known heddles are provided with corrugations for spacing the individual heddles from one another. For example, U.S. Pat. No. 1,246,002 discloses the provision of two lateral projections each in the upper area of the thread eye and the upper end loop of the heddle. U.S. Pat. No. 2,252,184 discloses protrusions on the heddles between the thread eye and the end loop for spacing the heddles apart. Additionally, a spring is provided to maintain the heddles together, i.e., to position the thread eyes of the individual heddles precisely.

U.S. Pat. No. 2,426,456 likewise discloses protrusions between the thread eye and the end loop for spacing the relatively large surfaces in the area of the end loop and the thread eye to prevent rusting. U.S. Pat. No. 3,349,811 discloses an arrangement of protrusions for spacing apart the heddles similarly as in U.S. Pat. No. 2,426,456. However such prior art approaches, despite the provision of corrugations or protrusions, the sticking together of the adjacent heddles persists and cannot be prevented reliably and with certainty in a manner to positively avoid sticking.

SUMMARY OF THE INVENTION

It is therefore an object of the present invention to provide weaving heddles which by effective yet simple means prevent the sticking together of the heddles without limiting the shed opening area and the row density of the weaving heddles mounted on the heddle frame.

Another object is to provide a simple yet highly effective means to positively prevent the sticking together of adjacent heddles, especially for those heddles arranged in pairs on a heddle frame of a weaving machine in which weft injection is effective via a water jet.

According to the invention each of the pair of heddles arranged upright on a heddle frame of a weaving machine has at least three deformations for spacing the heddles apart in each such pair, and for spacing the heddle pair apart from adjacent heddles of adjacent pairs. A first of such deformations is located at one of the end loops at the upper end of the pair, a second of such deformations is located at one of the end loops at the lower end of such pair, and a third of such deformations is spaced a predetermined distance in a direction toward the thread eye away from a first of the end loops at the lower end of the pair.

It is important according to the invention that two of the three distancing deformations in the area of the end loops of the heddle pair are located at the heddle openings provided for the heddle frame support bars. The third deformation is located in the area of the end loop at the bottom end of the weaving shaft, such third deformation being spaced a predetermined distance from the lower end loop in a direction toward the thread eye of the heddle.

Various combinations of the three spacing deformations provided for the heddle pairs are made possible in accordance with the invention.

The invention is now described in more detail in examples and with reference to the accompanying drawings.

DETAILED DESCRIPTION OF THE INVENTION

Figure 1:
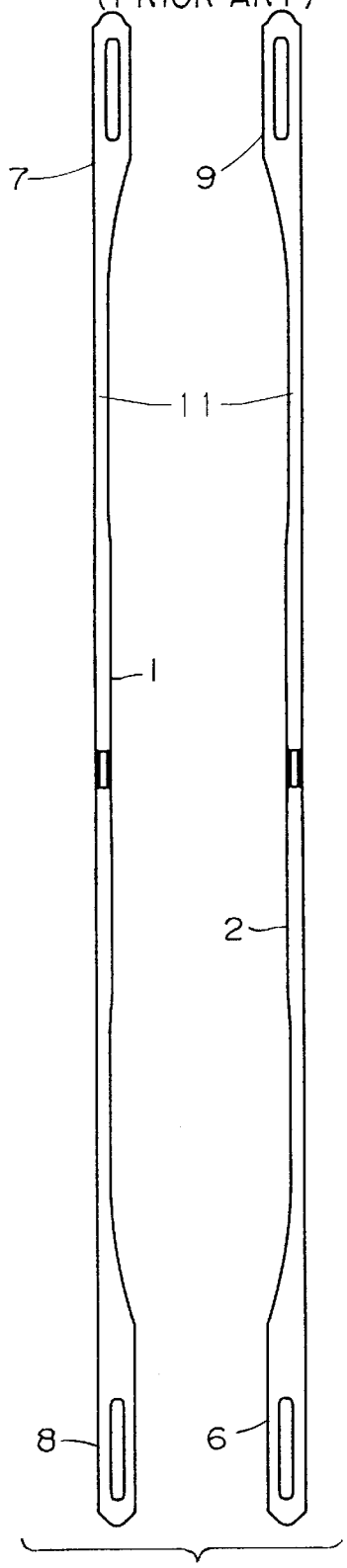
Fig. 1 (PRIOR ART)
FIG. 1 is a plan view of heddle pair of known construction frequently used on water-jet weaving machines with end loops and thread eyes.

As heretofore mentioned FIG. 1 illustrates a heddle pair 11 of heddles 1 and 2 basically of known construction.

Heddle 1 has end loops 7 and 8 at opposite ends of its elongated shaft, and heddle 2 has end loops 9 and 6 at the opposite ends of its elongated shaft.

Figure 2:
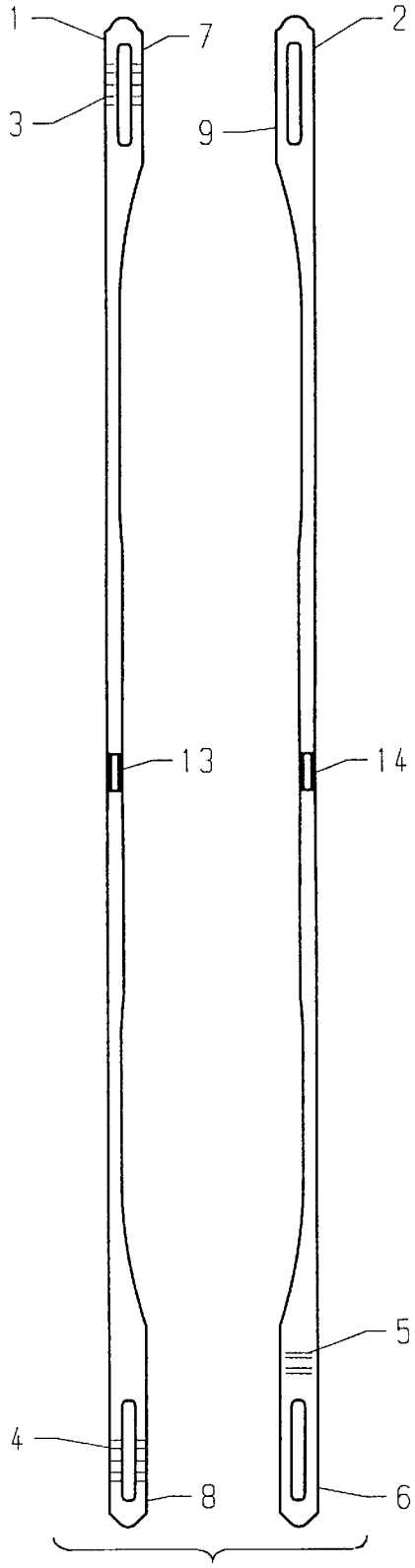
FIG. 2 is a plan view similar to FIG. 1 of a heddle pair incorporating the three deformations according to the invention.

FIG. 2 illustrates the same heddles 1 and 2 of the pair as incorporating the present invention. Thus, heddle 1 is provided with distancing deformations in the form of corrugations 3 and 4 in the areas of both end loops 7 and 8 with both corrugations located in the area of the openings for the heddle frame support bars. Heddle 2 of the pair, however, has only a single corrugation 5 which, while located in a wide area of the lower end loop 6, is however spaced a distance from the lower end loop in a direction toward thread eye 14. This spacing from the lower end loop may be approximately 20 mm. Corrugation 5 can, however, be modified to the individual shape of the heddle and spaced in a range of from 10 to 50 mm, depending on the arrangement of the lower end loop.

Figure 3:
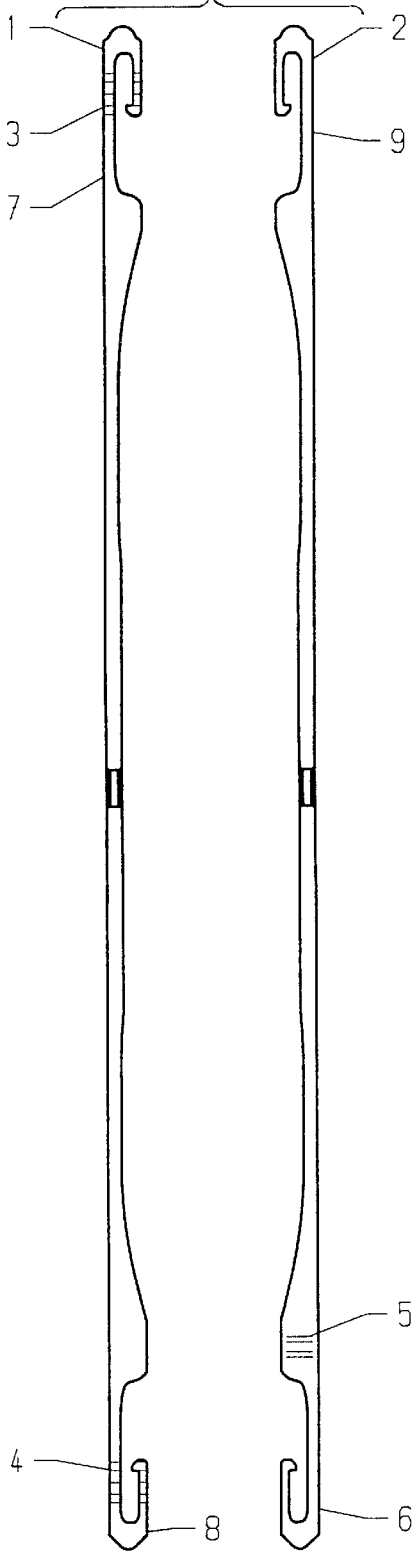
FIGS. 3 and 4 are plan views of heddle pairs incorporating the invention for so-called rider-less heddles.
Figure 4:
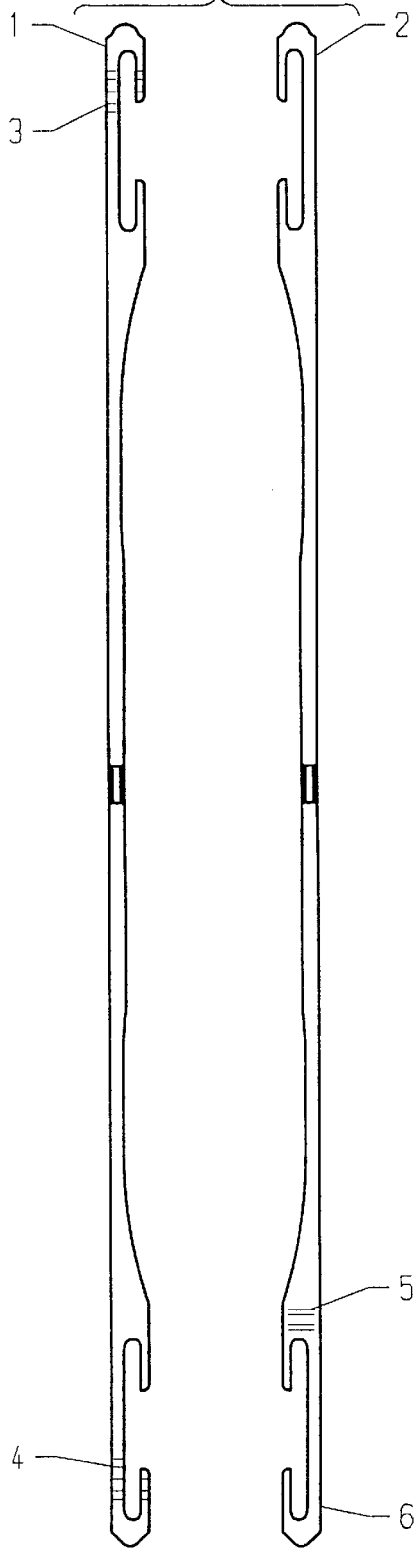

The heddle pair of the invention as aforedescribed has three corrugations in which one of the heddles of the pair has two corrugations, and in which the other heddle of the pair has only one corrugation, is a preferred embodiment. The invention may likewise be incorporated in so-called riderless heddles, as shown in FIGS. 3 and 4. In FIG. 3 the heddles are known as the J-type, and corrugations 3, 4 of the invention are located at end loops 7 and 8. Corrugation 5 is spaced from end loop 6 of heddle 2 similarly as in FIG. 2. In FIG. 4 the heddles are sometimes referred to as of the C-shape, and corrugations 3, 4 according to the invention are provided at the end loops of heddle 1, while corrugation 5 is inwardly spaced from end loop 6 of heddle 2, again similarly as in FIG. 2.

Figure 5:
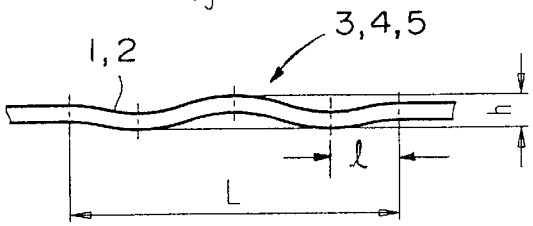
FIG. 5 is a side view of part of a heddle showing a substantial S-shaped corrugation protruding from both sides of the heddle shaft shown in enlarged form.

Each of the corrugations 3, 4, 5 which may be similar, is detailed in FIG. 5 in which the corrugation height h is in the range of from 0.4 mm to maximally 1.2 mm with the preferred height of 0.6 mm, since this forms a suitable spacing distance to the adjacent heddle while still not causing a substantial limitation in the row density of the heddles mounted in the machine frame. A distance l between the humps of the corrugation preferably measures 2 mm and the total length of the corrugation is 6 mm. Depending on the formation of the end loops these measurements can vary whereas length L of the corrugations should not exceed 15 mm, since otherwise the corrugation will become too flat thereby defeating the function of the corrugations as a spacer designed to prevent the sticking together of the heddles.

Figure 6:
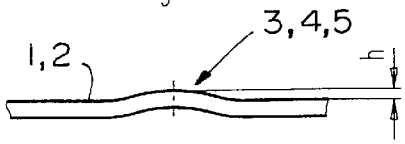
FIG. 6 is a view similar to FIG. 5 of a one-sided corrugation.

Also a one-sided arrangement of the corrugation as shown in FIG. 6 is possible, whereas height h is then about 0.2 to 0.5 mm with a preferred height of 0.3 mm to avoid the corrugation from becoming too flat and therefore defeat its function as a spacer to prevent the sticking together of the heddles.

The shape of the corrugations are substantially sinusoidal-shaped as shown in FIGS. 5 and 6, although they are not limited to such shapes. Thus the radii of the corrugations can be arranged much smaller or the corrugation can be angular or trapezoidal, or the number of humps per corrugation could be increased or decreased within the teachings of the invention. It is likewise within the scope of the invention to vary the location of the minimum of three deformations per heddle pair, as set forth schematically in FIGS. 8 to 10.

Figure 7:
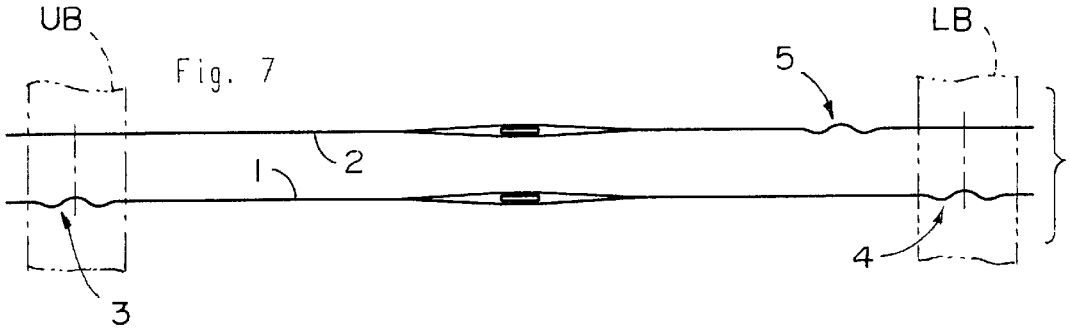
FIG. 7 schematically illustrates a preferred distribution of the deformations with two deformations on one heddle and a third deformation on the other heddle of the pair.

The corrugations in the heddle pair shown in FIG. 7 are essentially the same as that described above with reference to FIG. 2. The upper and lower support bars of the heddle frame, generally designated U B, and L B, and illustrated in phantom in FIG. 7, are shown merely for the purpose of the orientation of the heddle pair when mounted within the heddle frame of the weaving machine.

Figure 8:
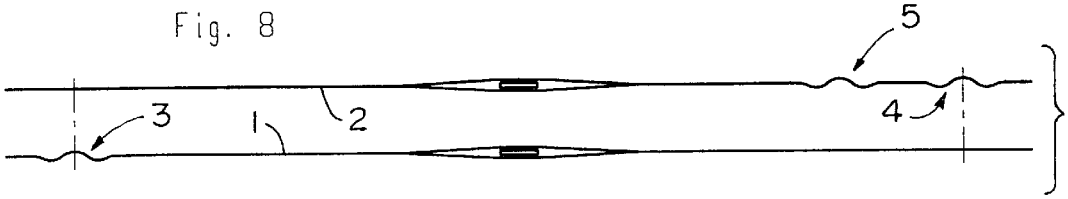
FIG. 8 is a view similar to FIG. 7 of another possible distribution of the corrugations at a ratio of 2:1.

In the heddle pair shown in FIG. 8 corrugation 3 at upper end loop 7 is the same as in FIGS. 2 and 7, except that corrugation 4 is located in heddle 2 at its lower end loop 6. Corrugation 5 is spaced inwardly of end loop 6 similarly as in FIG. 7.

Figure 9:
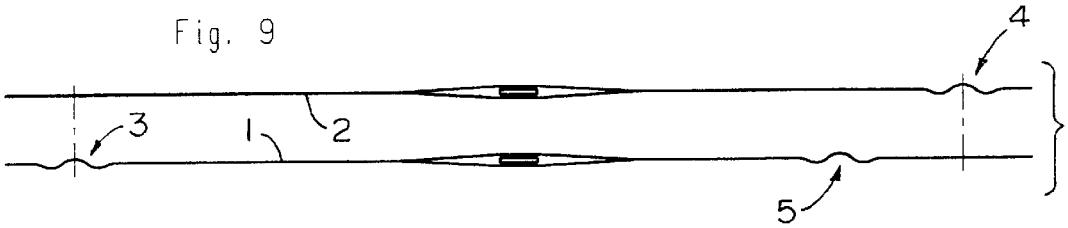
FIG. 9 is a view similar to FIG. 7 of yet another possible distribution of the corrugations on both of the heddles of the pair.

In the FIG. 9 modification, corrugation 3 again is at upper end loop 7 in heddle 1, the same as in FIGS. 7 and 8, and corrugation 4 is similarly located as in FIG. 8, i.e., at lower end loop 6 of heddle 2. However corrugation 5 in the FIG. 9 heddle pair is located in heddle 1 at a distance inwardly spaced from its lower end loop 8 in a direction toward thread eye 13.

Figure 10:
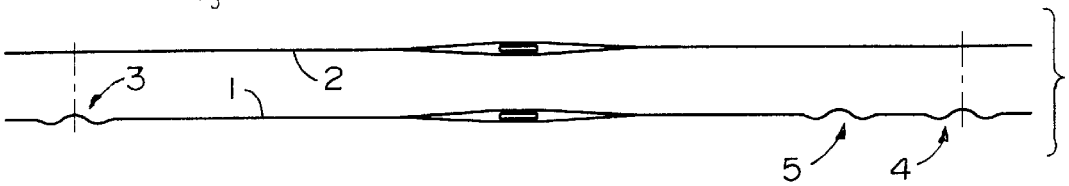
FIG. 10 is a view similar to FIG. 7 of yet another possible distribution of the corrugations in which one of the heddles of the pair has all three corrugations and the second heddle is devoid of such corrugations.

In the FIG. 10 embodiment corrugation 3 is again located at end loop 7 which is the same as in FIGS. 7, 8 and 9, and corrugation 4 is located at lower end loop 3 in heddle 1 as in the FIGS. 2 and 7 embodiment. However, corrugation 5 is likewise located in heddle 1 spaced inwardly from lower end loop 8 at a predetermined distance toward thread eye 13. Thus, heddle 2 of the pair in the FIG. 10 embodiment is completely devoid of any deformations or corrugations to effect the spacing according to the invention.

It is essential to the invention that the heddle pair have at least three deformations which have the effect of distancing weaving heddles from one another in the pair, and from adjacent heddles of adjacent pairs. It is further essential that at least one deformation each be provided in the area of the end loops or in the area of the end loops provided for engaging the heddle support bar (as in the FIGS. 3 and 4 versions), and that at least one deformation be located at that end of the heddle pair which is to be held on the lower heddle support bar, and that the third deformation be provided as spaced from the lower end loop toward the thread eye of a given heddle.

It is especially essential that two deformations be located in the area of that end loop which is provided to be arranged on the lower heddle support bar. It has been shown that arrangement of either one or the other deformation in the area of this lower end loop does not effect adequate distancing of the heddle from one another, thus making it possible for the aforedescribed problem to persist. In the area of that end loop which is provided to be arranged on the upper heddle support bar it is, however, not necessary to provide two deformations per weaving heddle pair. It is sufficient to provide a deformation in the area of the opening of the upper end loop, whereas in some cases this deformation can be slightly moved in a further undisclosed embodiment toward the thread eye of the heddle. Of course it is also possible to provide two deformations in the upper area; however, this is not necessary.

What is claimed is:

1. Weaving heddles arranged upright in pairs along a frame axis on a heddle frame of a weaving machine, each of said heddles comprising an elongated shaft of a predetermined width respectively having central axes, each said pair having upper and lower ends, end loops at said ends and thread eyes between said ends, each of said end loops being of a width greater than said predetermined width and laterally extending toward one another respectively at said upper and lower ends such that said central axes of each said pair are offset from said frame axis and the shafts of each pair are non-coincident, each said pair of said heddles having at least three deformations for spacing said heddles apart in each said pair to prevent sticking together of said heddles and for spacing the pair of said heddles apart from adjacent heddles in adjacent pairs of said heddles to prevent sticking together of said adjacent pairs, a first of said deformations being located only at a heddle bar opening at one of the end loops at the upper end of said pair, a second of said deformations being located only at a heddle bar opening at an end loop at the lower end of said pair, and a third of said deformations being located at an end loop only at the lower end of said pair and spaced a predetermined distance in a direction toward said thread eyes and away from a heddle bar opening at a first of the end loops at the lower end of said pair.

2. The weaving heddles according to claim 1, wherein each said deformation comprises at least one rounded corrugation.

3. The weaving heddles according to claim 1, wherein each said deformation comprises corrugations having S-shaped humps protruding toward one of said adjacent pairs and toward a confronting one of said heddles of said pair, the height of adjacent humps being 0.4 to 1.2 mm.

4. The weaving heddles according to claim 1, wherein said predetermined distance of said third deformation is between 10 mm and 50 mm from said first end loop.

5. The weaving heddles according to claim 1, wherein said first and second deformations are located in one of said heddles of said pair and said third deformation is located in the other of said heddles of said pair.

6. The weaving heddles according to claim 1, wherein said first deformation is located in one of said heddles of said pair and said second and third deformations are located in the other of said heddles of said pair.

7. The weaving heddles according to claim 1, wherein said first and third deformations are located in one of said heddles of said pair and said second deformation is located in the other of said heddles of said pair.

8. The weaving heddles according to claim 1, wherein said first, second and third deformation are located in one of said heddles of said pair, the other of said heddles of said pair being completely devoid of any said deformations.

* * * * *